US009284075B2

(12) United States Patent
Bierschenk

(10) Patent No.: US 9,284,075 B2
(45) Date of Patent: Mar. 15, 2016

(54) APPARATUS FOR COMPACTING PRODUCT AND HIGH SPEED BAGMAKING

(71) Applicant: Frito-Lay North America, Inc., Plano, TX (US)

(72) Inventor: Patrick J. Bierschenk, Dallas, TX (US)

(73) Assignee: Frito-Lay North America, Inc., Plano, TX (US)

( * ) Notice: Subject to any disclaimer, the term of this patent is extended or adjusted under 35 U.S.C. 154(b) by 460 days.

(21) Appl. No.: 13/764,133

(22) Filed: Feb. 11, 2013

(65) Prior Publication Data

US 2013/0152509 A1 Jun. 20, 2013

Related U.S. Application Data

(63) Continuation-in-part of application No. 12/604,748, filed on Oct. 23, 2009, now Pat. No. 8,371,094.

(51) Int. Cl.

| | |
|---|---|
| ***B65B 1/00*** | (2006.01) |
| ***B65B 9/20*** | (2012.01) |
| ***B65B 37/18*** | (2006.01) |
| ***B65B 65/00*** | (2006.01) |
| *B65B 1/22* | (2006.01) |
| *B65B 1/32* | (2006.01) |

(52) U.S. Cl.

CPC ... *B65B 1/00* (2013.01); *B65B 9/20* (2013.01); *B65B 37/18* (2013.01); *B65B 65/006* (2013.01); *B65B 1/22* (2013.01); *B65B 1/32* (2013.01); *B65B 2210/02* (2013.01)

(58) Field of Classification Search

CPC ..... B65B 1/00; B65B 9/20; B65B 37/18; B65B 65/006; B65B 1/22; B65B 1/32; B65B 2201/02

USPC ..... 53/438, 525, 551

See application file for complete search history.

(56) References Cited

U.S. PATENT DOCUMENTS

| | | | | |
|---|---|---|---|---|
| 3,040,490 | A | 6/1962 | Virta | |
| 3,070,931 | A * | 1/1963 | Zwight | 53/552 |
| 3,175,337 | A | 3/1965 | Roberts | |
| 3,285,294 | A | 11/1966 | Minera | |

(Continued)

FOREIGN PATENT DOCUMENTS

| | | |
|---|---|---|
| FR | 2819235 A1 | 7/2002 |
| WO | 96/17773 A1 | 6/1996 |

OTHER PUBLICATIONS

EP Search Report mailed May 23, 2014 from Europe Application 10825804.7 (5 pages).

(Continued)

*Primary Examiner* — Sameh Tawfik

(74) *Attorney, Agent, or Firm* — Colin P. Cahoon; Celina M. Orr; Carstens & Cahoon, LLP

(57) ABSTRACT

A method for compacting and packaging a plurality of slugs of product and apparatus for accomplishing the same. The invention describes collecting weighed product in an intermediate settling device to form compact slugs of product. The device can comprise a single settling chamber for each slug of product or can comprise multiple settling chambers which are axially rotatable. The slugs can be compacted by jostling and/or vibrating the settling device. Thereafter, the slugs of product are discharged to a multiple bagmaking packaging apparatus.

9 Claims, 6 Drawing Sheets

(56) References Cited

U.S. PATENT DOCUMENTS

| | | | | | |
|---|---|---|---|---|---|
| 3,307,646 | A | * | 3/1967 | Hage | 177/98 |
| 3,482,373 | A | | 12/1969 | Morris | |
| 3,561,504 | A | | 2/1971 | Tanner | |
| 3,579,945 | A | | 5/1971 | Buchner | |
| 3,584,697 | A | | 6/1971 | Danielson | |
| 3,703,796 | A | | 11/1972 | Inoue | |
| 3,853,190 | A | | 12/1974 | Delesdemier | |
| 4,049,028 | A | * | 9/1977 | Harris et al. | 141/10 |
| 4,073,121 | A | | 2/1978 | Greenawalt | |
| 4,081,004 | A | * | 3/1978 | Harris | 141/10 |
| 4,096,938 | A | * | 6/1978 | Payne | 414/790.3 |
| 4,159,150 | A | * | 6/1979 | Rachais | 406/75 |
| 4,365,460 | A | | 12/1982 | Cress | |
| 4,398,612 | A | | 8/1983 | Mikami et al. | |
| 4,407,108 | A | | 10/1983 | Craig | |
| 4,516,644 | A | | 5/1985 | Fukuda | |
| 4,520,883 | A | | 6/1985 | Fukuda | |
| 4,561,510 | A | | 12/1985 | Sugioka et al. | |
| 4,580,698 | A | | 4/1986 | Ladt | |
| 4,629,017 | A | | 12/1986 | Shroyer | |
| 4,729,210 | A | | 3/1988 | Galliano | |
| 4,779,402 | A | | 10/1988 | Duynhoven et al. | |
| 4,800,707 | A | | 1/1989 | Rabus | |
| 4,820,315 | A | | 4/1989 | DeMarco | |
| 4,832,178 | A | | 5/1989 | Anderson | |
| 5,029,735 | A | | 7/1991 | Dennis | |
| 5,125,213 | A | * | 6/1992 | Focke et al. | 53/437 |
| 5,155,980 | A | | 10/1992 | Mansson et al. | |
| 5,235,794 | A | | 8/1993 | Center | |
| 5,279,098 | A | | 1/1994 | Fukuda | |
| 5,289,724 | A | | 3/1994 | Hafner | |
| 5,473,866 | A | | 12/1995 | Maglecic | |
| 5,505,037 | A | | 4/1996 | Terminella | |
| 5,540,035 | A | | 7/1996 | Plahm et al. | |
| 5,551,206 | A | | 9/1996 | Fukuda | |
| 5,613,590 | A | | 3/1997 | Simionato | |
| 5,732,532 | A | | 3/1998 | Fujisaki | |
| 5,751,647 | A | | 5/1998 | O'Toole | |
| 5,755,082 | A | | 5/1998 | Takahashi et al. | |
| 5,768,852 | A | * | 6/1998 | Terminella et al. | 53/133.4 |
| 6,119,438 | A | | 9/2000 | Bacon et al. | |
| 6,199,351 | B1 | * | 3/2001 | Mount | 53/563 |
| 6,665,999 | B1 | | 12/2003 | Dierl et al. | |
| 6,718,739 | B2 | | 4/2004 | Kohl | |
| 7,028,448 | B2 | | 4/2006 | Engesser | |
| 7,099,741 | B2 | | 8/2006 | Baranowski | |
| 7,305,805 | B2 | | 12/2007 | Dierl et al. | |
| 7,328,544 | B2 | | 2/2008 | Yokota | |
| 8,371,094 | B2 | | 2/2013 | Bierschenk | |
| 2001/0005974 | A1 | | 7/2001 | Kondo | |
| 2002/0014055 | A1 | * | 2/2002 | Iwasa et al. | 53/551 |
| 2004/0026029 | A1 | | 2/2004 | Martin | |
| 2007/0062161 | A1 | | 3/2007 | Dierl et al. | |
| 2008/0283070 | A1 | * | 11/2008 | Jacobi et al. | 131/286 |
| 2011/0131934 | A1 | | 6/2011 | Bierschenk et al. | |
| 2011/0154783 | A1 | | 6/2011 | Bierschenk et al. | |
| 2011/0265432 | A1 | * | 11/2011 | Iwasaki et al. | 53/548 |
| 2012/0297738 | A1 | | 11/2012 | Krause et al. | |
| 2014/0020336 | A1 | | 1/2014 | Bierschenk | |

OTHER PUBLICATIONS

EP Search Report mailed May 19, 2014 from Europe Application 10825803.9 (10 pages).

U.S. Appl. No. 13/737,426, filed Jan. 9, 2013, entitled "Method and Apparatus for Compacting Product" by Bierschenk et al., a divisional application of U.S. Pat. No. 8,371,094 issued Feb. 12, 2013.

PCT Search Report for PCT Application No. PCT/US2014/015608 mailed Jun. 2, 2014 (9 pages).

* cited by examiner

APPARATUS FOR COMPACTING PRODUCT AND HIGH SPEED BAGMAKING

CROSS REFERENCE TO RELATED APPLICATIONS

This application is a continuation-in-part of co-pending U.S. patent application Ser. No. 12/604,748 filed Oct. 23, 2009, the technical disclosure of which is hereby incorporated by reference in its entirety.

BACKGROUND OF THE INVENTION

1. Technical Field

The present invention relates to an apparatus for compacting a plurality of slugs of product and packing said product slugs at high speeds.

2. Description of Related Art

Product often settles after it has been packaged making the package appear less than full. Thus, often a package appears full once it is manufactured, but after further settling appears less full. One example is that of a traditional flex bag containing snacks such as potato chips. Such flex bags are traditionally made and filled in a vertical form, fill, and seal machine. FIG. 1 depicts a portion of a traditional vertical form, fill, and seal machine. First, product is weighed and measured in a weigher 101. The weighers 101 collect and discharge a specified charge of product. Each charge represents the amount of product which will occupy a single bag. Downstream from the weigher 101 is typically a funnel 102 or a series of funnels which directs the product. As used herein, "downstream" and "upstream" refer to relative points or locations in the process or apparatus. Thus, an event taking place downstream occurs later in the process and follows events which took place upstream. Downstream from the funnel 102 is a product delivery cylinder 103. As used in a vertical form, fill, and seal machine, the product delivery cylinder 103 is often referred to as a former. The packaging film for the final package is wrapped around the product delivery cylinder 103 to form a tube. Once the lower portion of the tube is sealed, product is delivered through the product delivery cylinder 103 and into the sealed tube. Thereafter, the top portion of the tube is sealed, cut and separated from the upstream film, and a package is formed. The apparatus is a very effective bagmaker and can produce bag rates as high as 100 bags per minute.

During shipping and handling the product within the package begins to settle, increasing the void space at the top of the package. A package which has sat on a retail shelf, after transportation and handling, will often look less full than a package taken directly from the bagmaker. This results in a variety of problems. First, a package appearing and feeling less full is less appealing to a customer compared to a fuller package. Second, many consumers are unpleased to open a package to realize the package is about half full. Third, due to the increased void space after the product settles, the prior art package is larger than needed at this point relative to its contents. Such a package unnecessarily takes up valuable space on a retail shelf space, in shipping trucks, in warehouses, and in consumers' pantries. Further, manufacturing materials such as plastic films are wasted in forming such a package.

For the above reasons, attempts have been made to decrease the void space in a package. One attempt disclosed in commonly owned U.S. Publication No. 2006/0165859 which teaches that randomly shaped product tends to settle less over time than uniformly shaped product and thus discloses producing randomly shaped product. One drawback of this method, however, is that is it not always desirable to produce randomly shaped products.

Another known method is partially filling the package with product, vibrating the package to settle the product within the package. Thereafter additional product is added to the package and the process repeated. Unfortunately, this process is very slow and cannot be conducted at high rates on a traditional vertical form, fill, and seal machine.

Accordingly, one object of the instant invention is to provide an apparatus and method which results in increased compaction of product within a package. Furthermore, because many packages involve a vertical form, fill, and seal machine, it is desirable that the apparatus and method be easily adapted for use on such a machine, preferably with only minor modification and without significantly decreasing bag rates.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicants' invention will now be described with reference to the drawings. Unless otherwise noted, like elements will be identified by identical numbers throughout all figures.

Generally, this invention relates to a method and apparatus for compacting a slug of product and increasing compaction of product within a package. Compaction refers to the density of product within a package. A goal is to form and compact an intermediate slug of product which is subsequently discharged into a packaging apparatus and eventually into a package. An additional goal in one embodiment is to ensure the increased compaction remains throughout the packaging operation. Applicants have found forming and compacting an intermediate slug and then discharging said slug for packaging results in increased product compaction. A slug of product refers to a collected charge of product.

Because of the resulting increased compaction of the product at the bagmaker, less settling occurs during the subsequent, shipping, handling, and displaying of the package. Thus, the apparatus and method of this invention ensures that the package displayed on the shelf will more resemble the package as seen at the bagmaker. As used herein, a bagmaker refers to any packaging apparatus. The method and apparatus can be utilized on a wide variety of bagmakers including but not limited to a vertical form, fill, and seal machine and horizontal form, fill, and seal machines, bag in a box apparatus, as well as boxing machines. Likewise, a packaging apparatus referred to as a fill seal bagmaker, whereby premade bags are opened, filled, and sealed, can also be utilized. The final packages described herein can comprise traditional flex packages associated with snack product, vertical packages, box packaging, bag in a box packaging, and other products containing product which is subject to settling.

The apparatus and method can be utilized to increase compaction of a variety of products including food products such as chips, pretzels, cookies, noodles, nuts, cereal, and seeds. Likewise, this invention also applies to individually wrapped products such as individually wrapped mints or other candies which are susceptible to settling. The apparatus and method also works for other various dry products including dog food, cat food, etc.

Figure 1:
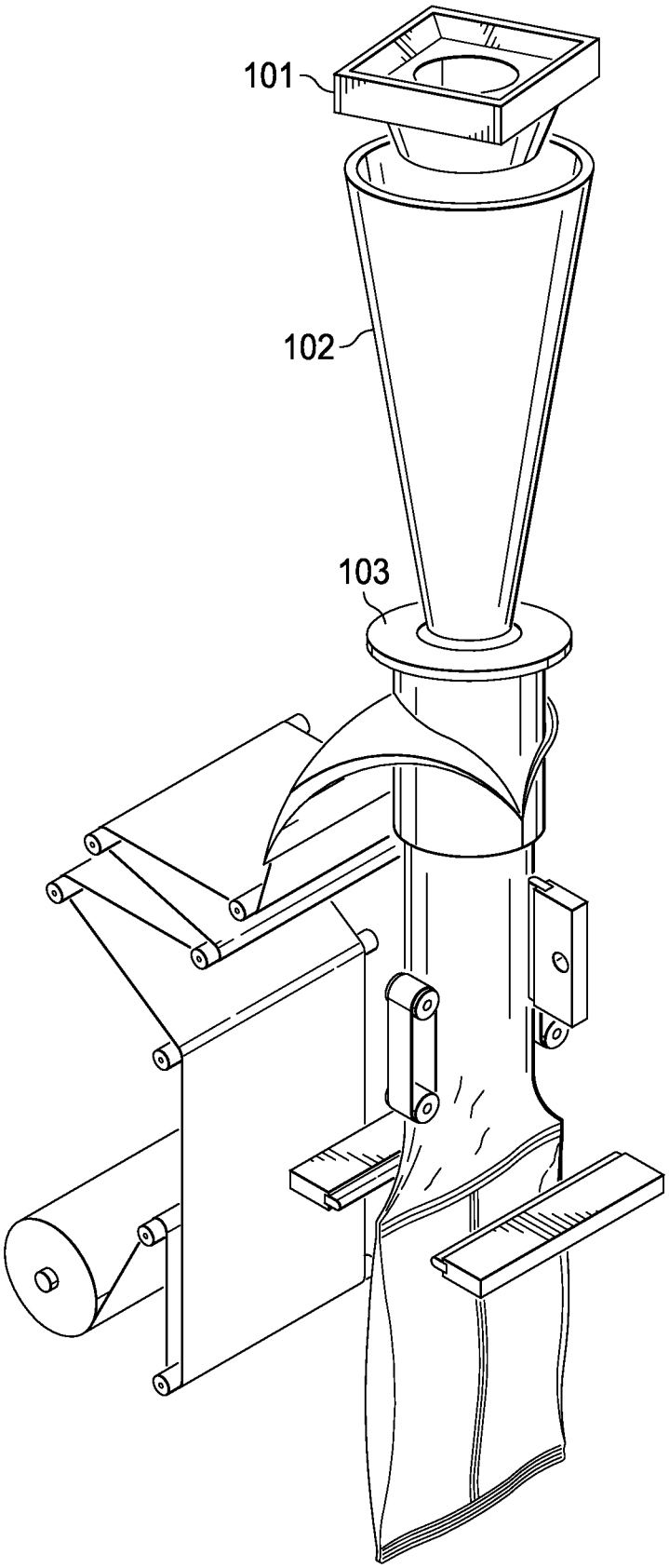
FIG. 1 (PRIOR ART)
FIG. 1 is a perspective view of a prior art filling apparatus.
Figure 2:
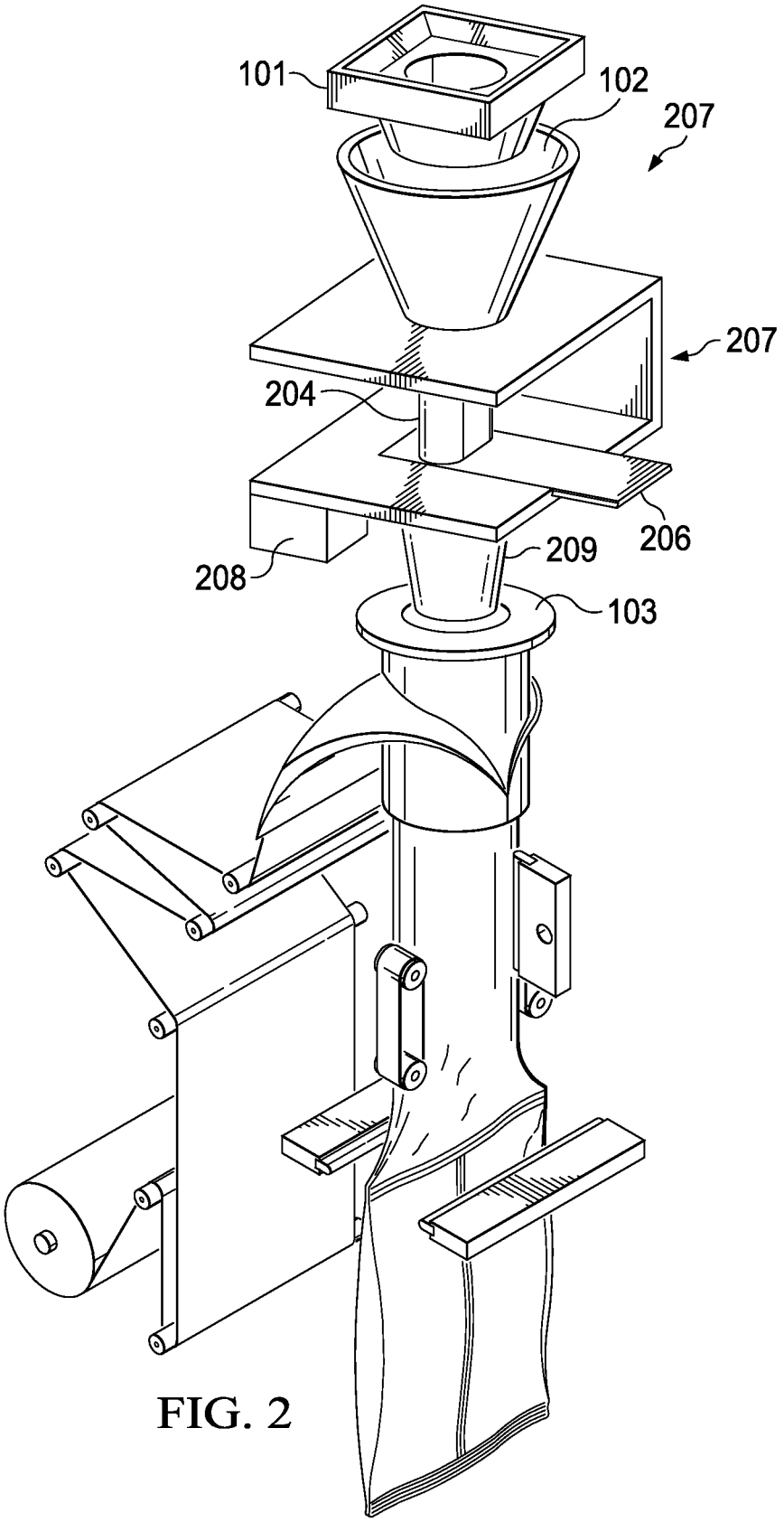
FIG. 2 is a perspective view of a filling apparatus employing one embodiment of the invention comprising a settling chamber.

FIG. 2 is a perspective view of a filling apparatus employing one embodiment of the invention comprising a settling chamber. In FIG. 2, a settling device 207 is located between the weigher 101 and the product delivery cylinder 103 of a vertical form, fill, and seal machine. The weigher 101 can comprise virtually any weigher known in the art. In one embodiment, the weigher 101 is a statistical weigher. As depicted, downstream of the weigher 101 is a receiving funnel 102. A receiving funnel 102, or a series of funnels, receives and guides product to the downstream bagmaker. As used herein a receiving funnel 102 refers to any device downstream of a weigher but upstream from a settling device which collects and directs product. The receiving funnel 102 can be attached and part of the weigher 101 and can comprise vertical or slanted walls. In one embodiment, there is a metal detector located between the weigher 101 and the receiving funnel 102 to monitor foreign debris. Those skilled in the art will appreciate that a receiving funnel 102 is not necessary in all embodiments. Downstream of the receiving funnel 102 and the weigher 101 is the settling device 207.

As depicted the settling device 207 comprises a single settling chamber 204, a vibrator 208, and a gate 206. A settling device, as used herein, refers to a device which receives and captures an amount of product in order to form an intermediate slug of compacted product. A settling chamber 204 is a distinct chamber which receives and retains product. In one embodiment the settling chamber 204 has four vertical walls and an open top and bottom.

Applicants have found that collecting product discharged from the weigher 101 and holding product, for a period of time, in the settling chamber 204 facilitates settling of the product and increases compaction of the product. Increasing the settling of the product during packaging results in a decrease of post manufacturing settling. The settling chamber 204 can be jostled or vibrated via a vibrator 208 to facilitate and speed up the settling of the product. The time necessary and the amount of external energy, such as vibrations, required to facilitate settling is dependent upon many factors including but not limited to the geometry of the product, the size and geometry of the settling chamber, the size of the slug, and the level of compaction desired. Those skilled in the art will be able to determine the amount of time and energy required to yield a desired level of compaction. Other movements such as vertical, horizontal, rotational, vibrational, and mixtures thereof can also be imparted to the settling chamber to facilitate settling of the product which results in increased compaction. The vibrator 208, which is optional, can comprise any device which vibrates the settling chamber 204. The vibrator 208 can be located in various places throughout the settling device 207.

Applicants have found that the geometry of the settling chamber 204 has an effect on the shape of the packaged slug as well as the shape of the final package, especially if the final package is a traditional flex bag. In one embodiment the cross-sectional shape of the settling chamber 204 is substantially similar to the desired shape of the slug. For example, in one embodiment the settling chamber 204 has a substantially oval cross-section to mimic the substantially oval cross-section of a traditional flex bag. Other cross-sections may be utilized including but not limited to a circular and square cross-section.

The height of the settling chamber 204 can be varied according to the desired size and shape of the intermediate slug which ultimately dictates the size and shape of the finished product. In one embodiment the size of the settling chamber 204 is approximately 0.5 to 2.5 times the height of the final package, and in one embodiment the settling chamber 204 is approximately 1.25 times the height of the final package. The size of the chamber is dependent upon a variety of factors including the amount of settling required. In one embodiment, the height of the settling chamber 204 is chosen so as to properly fit between the weigher and the packing apparatus without raising the weigher.

In one embodiment, the bottom of the settling chamber 201 has a larger opening than the top of the settling chamber. For some products susceptible to bridging, having a larger exit diameter minimizes bridging. This helps the product maintain its desired compact shape and results in faster and more efficient discharges.

At the bottom of the settling chamber 204 is a gate 206. The gate 206 can comprise many types of gates including sliding and swinging gates. In one embodiment the gate 206 is a sliding gate which allows for quick and efficient discharge of the product from the settling chamber 204.

Downstream of the gate 206 is the product delivery cylinder 103. In some embodiments there is an intermediate funnel 209 which directs product discharged from the gate 206 to the product delivery cylinder 103. The intermediate funnel 209 can comprise one or more funnels which can comprise straight or slanted walls. Further, the intermediate funnel 209 can comprise a variety of shapes. In one embodiment, the intermediate funnel 209 has a shape similar to the shape of the settling chamber 204.

In some embodiments, as the process moves downstream from the receiving funnel 102 to the product delivery cylinder 103, each subsequent downstream transition point has a larger diameter than the upstream transition point. Thus, in such an embodiment, the intermediate funnel 209 has a larger diameter than the settling chamber 204 but a smaller diameter than the product delivery cylinder 103. Such an arrangement minimizes bridging and any other disruption to the united slug.

Thus, the method for compacting a slug of product begins by weighing an amount of product in a weigher. Then, the product is directed and received into a settling device. Once the product is in the settling device, the product is compacted to form a slug of product. As discussed, this can be accomplished by storing the product for a time, or by jostling, rotating, and/or vibrating the settling device. After compacting the product, the product is discharged to a product delivery cylinder. It should be noted that the product can be directly discharged into the product delivery cylinder or it can be discharged into an intermediate funnel or chute before reaching the product delivery cylinder. Thereafter the slug is deposited from the product delivery cylinder into a package. As discussed above, the settling device is located downstream from a weigher and upstream from the product delivery cylinder. Further, the settling device can comprise only a single settling chamber, or the device can comprise more than one settling chamber.

In one embodiment the settling device 207 comprises only a single settling chamber 204. However, in other embodiments the settling device 207 comprises more than one settling chamber 204. In one embodiment, two or more settling chambers 204 act in parallel, each discharging its slug to the downstream product delivery cylinder 103. In other embodiments at least two chambers 204 act in series whereby a first chamber is located below a second chamber and product is partially settled in a first chamber before being deposited for further settling in a second chamber. In one embodiment, one or more settling chambers 204 are located on a rotary settling device. In one embodiment each subsequent chamber results in increased settling.

Figure 3:
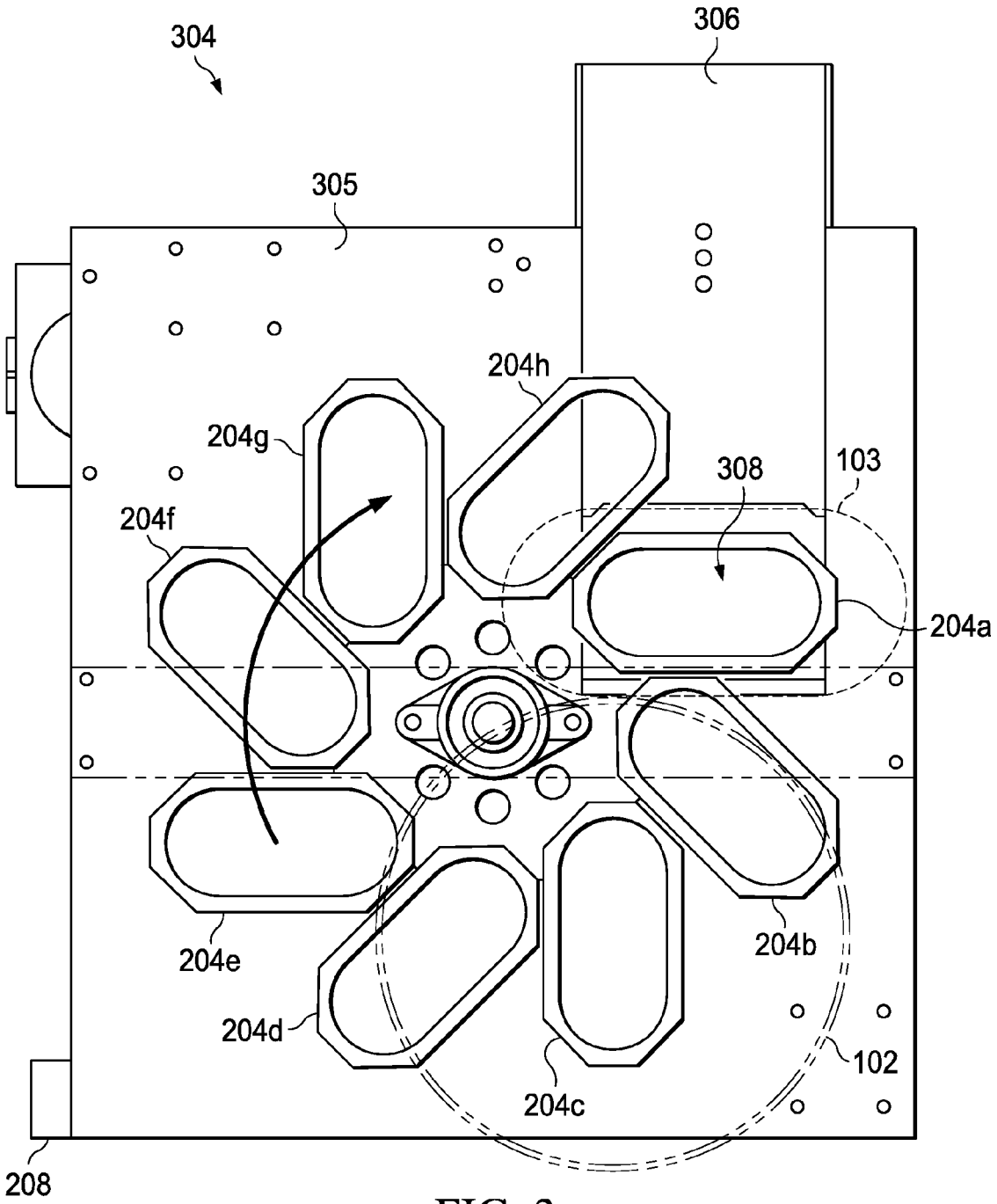
FIG. 3 is a top profile view of a rotary settling device comprising multiple settling chambers in their discharging and receiving positions.

FIG. 3 is a top profile view of a rotary settling device comprising multiple settling chambers in their discharging and receiving positions. A rotary settling device 304 is a device comprising more than one settling chamber whereby the settling chambers are axially rotatable within the settling device. FIG. 3 illustrates a rotary settling device 304 comprising eight settling chambers 204*a-h* located above the stationary turret table 305, a gate 306, and a vibrator 208. While the figure illustrates eight settling chambers 204*a-h*, other numbers of settling chambers may also be utilized. Those skilled in the art will understand that the number of required settling chambers is dependent upon a variety of factors including but not limited to the geometry of the product, the desired size and weight of each slug, and the desired throughput in bags per minute, amount of settling time required, etc.

In a rotary settling device 304, the settling chambers 204*a-h* can be arranged in a variety of positions. In one embodiment, the centers of each settling chamber are evenly spaced along the turret table 305. In one embodiment the chambers are evenly spaced and oriented like a wagon spoke. As depicted, the settling chambers 204 are angled relative to the turret table 305 to maximize the number of chambers which will fit on the turret table 305.

In the embodiment depicted, the settling chambers 204 have an open top and bottom so the product is maintained within the settling chambers 204 by the presence of the stationary turret table 305. In such an embodiment the settling chambers 204 glide and rotate over the turret table 305. There is an opening 308 in the turret table 305 located above the gate 306. In one embodiment, the shape of the opening corresponds to the shape of the settling chamber 204. The chamber located in the position above the gate 306, and aligned with the opening 308, is referred to as the discharge chamber 204*a*. The product in the discharge chamber 204*a* is maintained by the gate 306. Accordingly, when the gate 306 is opened, via sliding or otherwise, the product falls through the opening 308 in the turret table 305 and passes the open gate 306. Those skilled in the art will understand that there are other ways of maintaining product within each settling chamber such as having a separate gate for each settling chamber.

In one embodiment, downstream and below the gate 306 is the product delivery cylinder 103. In such an embodiment, the compacted slug is discharged from the discharge chamber and into the product delivery cylinder 103 where it is subsequently packaged in a bagmaker.

The settling chambers 204 can be filled in a variety of locations. In one embodiment, the discharge chamber 204*a* is also the same settling chamber which receives product, called the receiving chamber. In such an embodiment, after discharging product in the discharge chamber 204*a* the gate 306 will close. Thereafter, the discharge chamber 204*a* will then receive product. All of the settling chambers 204 in turn will then move one spot in the progression, during which time the product in the settling chamber settles and becomes more compact. Thus, in some embodiments the receiving and discharging do not take place simultaneously.

Figure 4:
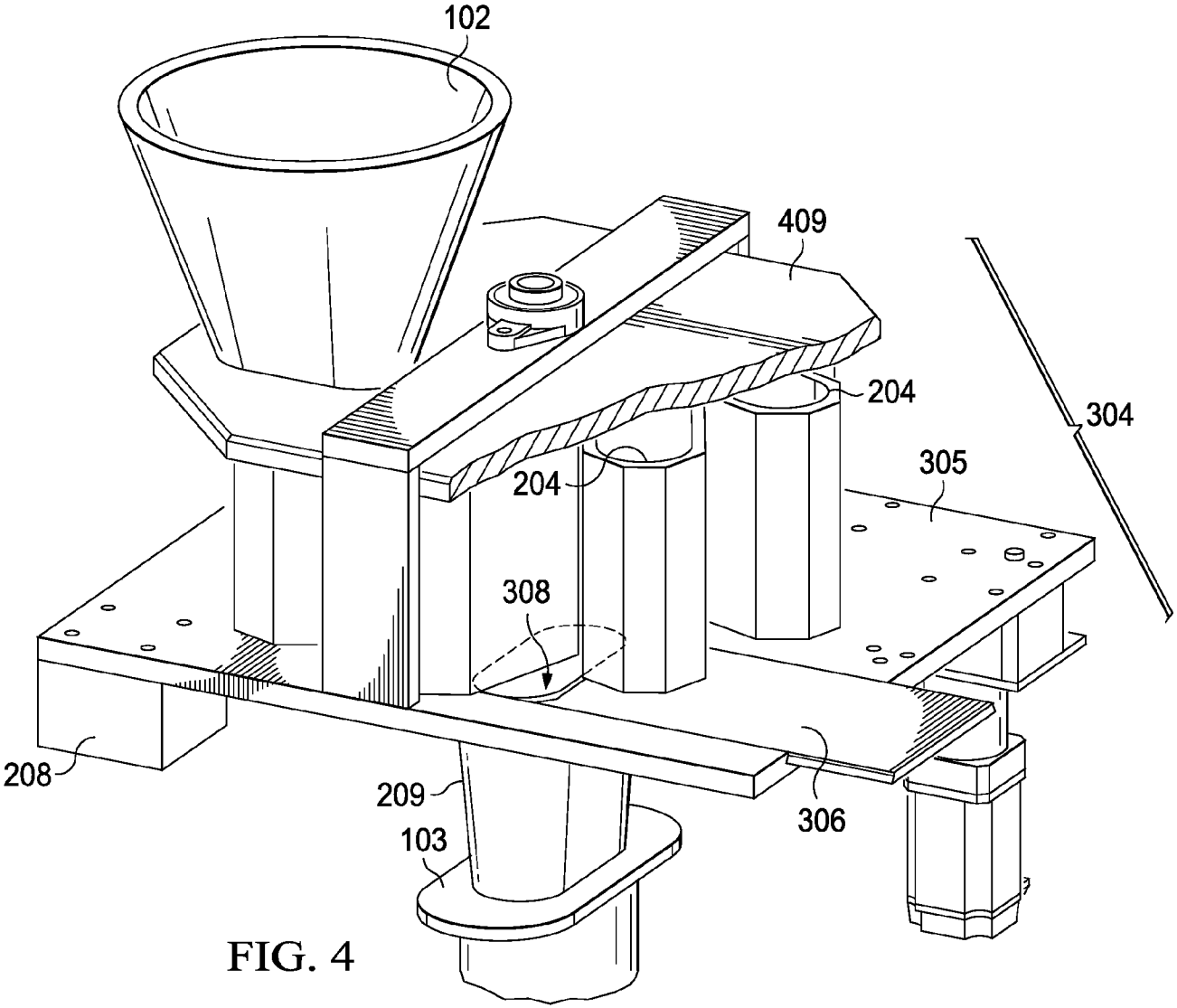
FIG. 4 is a perspective view of a rotary settling device comprising multiple settling chambers in a mid-rotation position.

FIGS. 3 and 4, however, depict an embodiment in which the receiving and discharging does not take place in the same chamber. As depicted in FIG. 3, the discharging chamber 204*a* discharges product and a different chamber, the receiving chamber 204*c* receives product from the receiving funnel 102. In one embodiment, the discharging and the receiving takes place simultaneously. Thus, after the discharge chamber 204*a* discharges its product, it rotates two positions to become the receiving chamber 204*c* at which time it receives product. In other embodiments the discharge chamber 204*a* will only rotate one spot before becoming the receiving chamber whereas in other embodiments the discharge chamber will rotate multiple positions before becoming the receiving chamber. The location of the receiving and discharging positions depends on a variety of factors including but not limited to the location of the receiving funnel 102 and the product delivery cylinder 103 and the required amount of settling.

After the receiving chamber 204*c* has received its product, it rotates clockwise throughout the positions until it again becomes the discharge chamber 204*a*. While the example has been described as rotating clockwise, this should not be deemed limiting as the device can also rotate counterclockwise.

While the settling chambers 204 are rotating, the product becomes more compact. In one embodiment, a vibrator 208 vibrates the product within the settling chambers 204 to facilitate settling of the product. The vibrator 208 can be placed on a variety of places, including but not limited to, on the stationary turret table 305, attached to the chambers 204, or otherwise attached to the rotary settling device 304 or other supporting structure.

As shown in FIGS. 3 and 4, the receiving funnel 102 is located atop the rotary settling device 304. The receiving funnel 102 directs product to the receiving chamber. As noted above, the receiving funnel 102 may be directly below the weigher 101 or it may be below another funnel or series of funnels.

FIG. 4 is a perspective view of a rotary settling device comprising multiple settling chambers in a mid-rotation position. FIG. 4 also illustrates the opening 308 located on the stationary table 305. As depicted, the chambers are in mid-rotation so the chambers are not receiving or discharging product. In other embodiments, however, product is received and/or discharged during rotation. In some embodiments, however, it is desired that the compact slug is maintained in its compact state after the slug has been formed.

In FIG. 4, a stationary top 409 is depicted. The top 409 acts to ensure that the product within the settling chambers 204 does not escape the settling chambers 204. Further, the top 409 acts to keep external items from entering the settling device and subsequently becoming packaged. The top 409 is not necessary in all embodiments, and those skilled in the art will understand which processing conditions will warrant such a top.

As depicted, the intermediate funnel 209 and the product receiving cylinder 103 are depicted downstream of the opening 308. In FIG. 4, the product receiving cylinder 103 is part of the bag former in a vertical form, fill, and seal, machine. In one embodiment, the product receiving cylinder 103 is directly connected to the rotary device 304. In other embodiments the product receiving cylinder 103 is not directly attached to the rotary device 304. The product receiving cylinder 103 may be separated from the rotary device 304 by a gap or it may be connected via other equipment such as the intermediate funnel 209.

In one embodiment, the product in the package comprises product from only a single settling chamber. In such an embodiment, the amount of product received in the receiving chamber is equal to the amount of product in the final package.

In still other embodiments, the final package comprises two slugs of product. In one embodiment the package comprises product from at least two different settling chambers. In other embodiments the package comprises two slugs of product from the same chamber. In such an embodiment a first slug is first formed and discharged and then subsequently a second slug is formed in the same chamber and then discharged.

Applicants have found that in some products the compaction is further increased when two or more smaller slugs are compacted separately and then added into a single package. For example, if the final product is to comprise two slugs of product, then the slugs formed from two different chambers will both be deposited to a single package. Referring back to FIG. 3, in such an embodiment a single package will comprise product discharged from the discharge chamber 204*a* as well as product from the chamber 204*h* located one spot behind the discharge chamber 204*a*. Thus, product from both chambers 204*a*/204*h* is deposited to a vertical form, fill, and seal machine to be packaged in a single package.

In one embodiment, the height of each chamber is selected so that existing apparatuses can be retrofitted with charge compaction without, for example, raising the weigher. As an example, in one embodiment, due to the multi-charge method, the settling chambers can be made shorter in height, due to the height being spread amongst multiple chambers, and as a result the weigher does not have to be moved. This results in decreased capital costs to retrofit an existing apparatus.

Applicants have found that after inducing settling the slug maintains its shape and compaction as it is packaged. This results in less settling after packaging giving the consumer a fuller package which more resembles the fuller look of a bag at the bagmaker. As previously discussed, increasing settling during packaging reduces post package settling which results in several benefits. One such benefit is the ability to use a comparatively smaller package for the same product weight. This results in decreased production costs as less material is required to manufacture the package. Additionally this results in decreased shipping costs as more packages can fit in a given volume. Further, this allows more packages to be displayed on the retail shelf as smaller packages occupy less space. Likewise, a smaller package allows a consumer to store the same amount of product in a smaller space, thus freeing valuable pantry space.

As discussed, this apparatus and method provide the opportunity to package the same quantity of product in a comparatively smaller package. The smaller package can have a decreased height, width, or combinations thereof compared to the previous package. In one embodiment the width of the package is not altered and only the height dimension is changed. Such an embodiment minimizes the modifications required to the bagmaker.

The following examples demonstrate the effectiveness of one embodiment of the instant invention and are for illustrative purposes only. Accordingly, the following examples should not be deemed limiting.

Control

A trial was conducted using chips with a product weight of 21.5 ounces. The wheat chips were thin wafers having ridges. A settling device was not used on the control. The bags had a width of 12 inches, a total height of 18.75 inches and a usable height of 17.75 inches after deducting one inch for the top and bottom seals. The void space in each package was measured and the fullness level of each bag calculated. The void space was measured by measuring the average level of product in the package. The packages removed from the bagmaker, which was a vertical form, fill, and seal machine, were approximately 86% full on average and had an average product level of 15.25 inches. Thereafter to determine the conditions of the packages after sitting on the shelf, the packages were subjected to a simulated retail process which included simulating the transporting, handling, and shelf time of a typical package. After simulation, the void space was measured and the fullness of each bag was calculated to be approximately 78% on average with a product level of 13.85 inches. Thus, the fullness of the packages decreased by about 8% on average after the shelf simulation, and the product level decreased by an average of 1.4 inches.

Single Charge

In the next trial, a non-rotary settling apparatus comprising a single settling chamber, similar to that of FIG. 2 in operation, was utilized using the single charge method whereby each package comprised a single slug of product. The settling device had settling chambers comprising a substantially oval cross section and a width of 12 inches. Because of the settling of the product, a smaller bag was utilized. The smaller bag had a width of 12 inches and a height of 16.75 inches with about 15.75 inches of useable space. At the bagmaker the packages were approximately 86% full and had a product level of about 13.55 inches. Thus, the settling device decreased the same quantity of product in a bag with the same width from a product level of 15.25 inches to a product level of 13.55 inches at the bagmaker. After the shelf simulation, the packages were approximately 82% full and had a product level of about 12.85 inches. Thus, the fullness of the package decreased by only about 4% and resulted in a fuller bag compared to the control. Further, the product level dropped only about 0.7 inches which is about half of the drop experienced in the control.

Multi-Charge

In the next trial, the same apparatus was utilized using the multi-charge method wherein the final package comprised two slugs of product. Thus, in this embodiment, the settling chamber formed and discharged a slug, and then the same settling chamber subsequently formed and discharged a second slug into the same package as the first discharged slug. The same size bag as the single charge was also used in the multi-charge trial. At the bagmaker the packages were approximately 87% full and had product levels of about 13.65 inches. After the shelf simulation, the packages were approximately 83% full and had a product level of about 13.15 inches. Thus, compared to the single-charge method, the multi-charge method resulted in a fuller bag both at the bagmaker and after shelf-simulations.

In both the single-charge and the double-charge, a smaller package was produced which held the same quantity of product as the larger bag in the control, but which required less material to manufacture. Accordingly, compacting the product results in decreased manufacturing costs, decreased shipping costs, an increased number of packages available for a given amount of retail space, a package which required less pantry space, and a package which appeared fuller to the retail consumer.

In one embodiment, charge compaction is combined with a multiple bagmaker to significantly increase the packaging speed and efficiency. Any multiple bagmaker known in the art can be used, and Applicants will describe the invention in relation to a duplex vertical form, fill and seal machine. Those skilled in the art will understand that the number of bags the multiple bagmaker produces at one time will dictate the necessary modifications to the weigher and charge compaction device.

Figure 5:
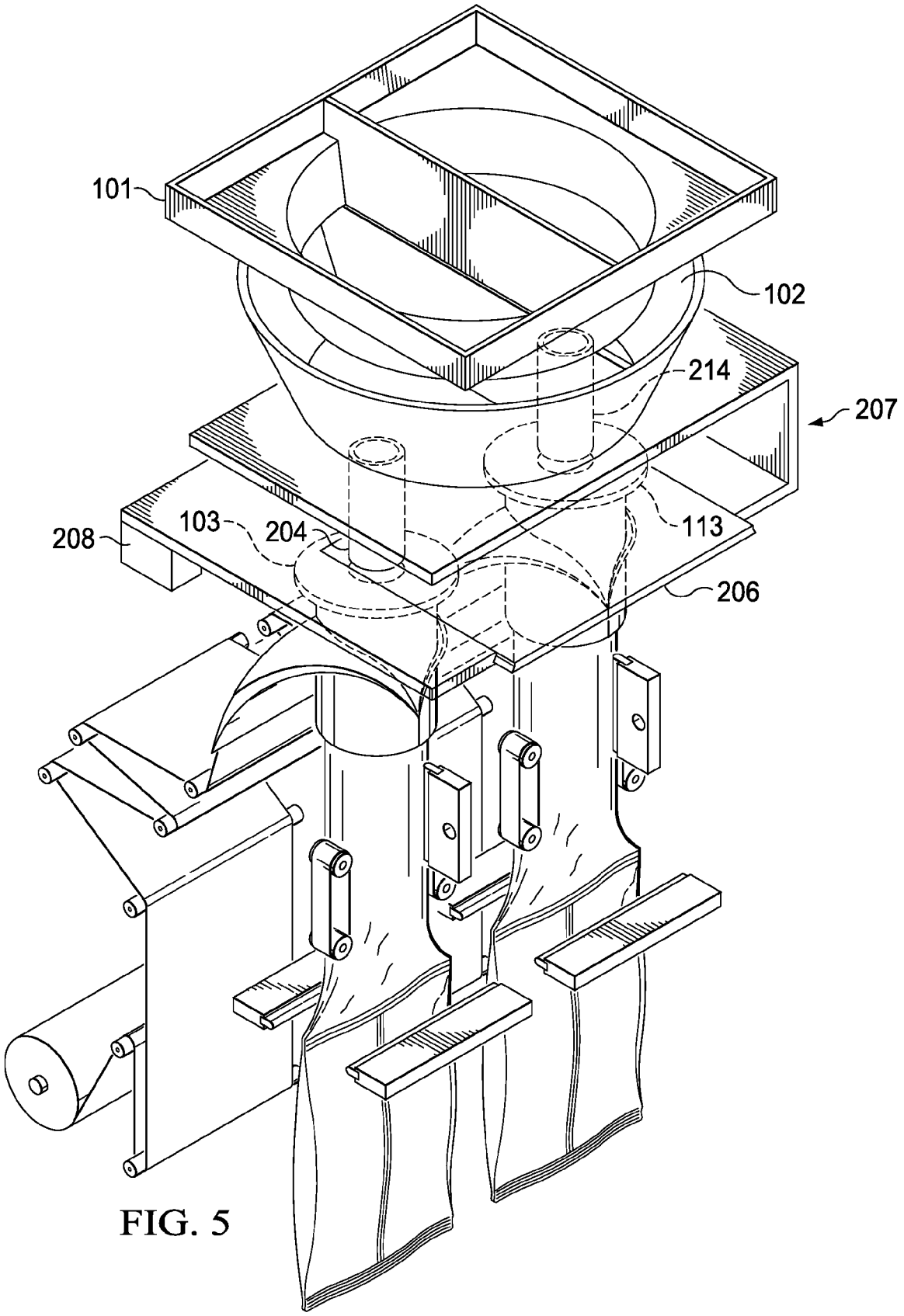
FIG. 5 is a perspective view of a filling apparatus employing one embodiment of the invention comprising a settling chamber and multiple bagmaker.

FIG. 5 is a perspective view of an apparatus with a multiple bagmaker incorporating charge compaction in accordance with one embodiment of the invention. In FIG. 5, a duplex vertical form, fill and seal machine with delivery cylinders 103 and 113 is utilized. The weigher 101 is split into two sections with each half weighing and discharging a slug of product into its corresponding half of the receiving funnel 102 which guides the product into the settling device 207. As depicted, the settling device 207 comprises two settling chambers 204, 214, each for a slug of product, a vibrator 208, and a gate 206. The product is discharged from the settling chambers 204, 214 through the gate 206 to the product delivery cylinders 103 and 113, respectively. While the example has been described as using a duplex vertical form, fill and seal machine, this should not be deemed limiting as the device can be adapted for any number of bagmakers.

The method for compacting and packaging a plurality of slugs of product simultaneously is substantially similar to that described above in relation to a single slug of product. A plurality of slugs of product is weighed in a split weigher. The number of sections into which the weigher is split is determined by the number of product delivery cylinders of the multiple bagmaker. Thus, for a duplex bagmaker the weigher is split into two sections, three sections for a triplex bagmaker and so on. The slugs of product are then directed from the weigher and received into a settling device. Once the slugs of product are in the settling device, the slugs are compacted to form compacted slugs of product. After compacting, the slugs are discharged to a number of product delivery cylinders. Thereafter the slugs are deposited from the product delivery cylinders into a corresponding number of packages.

Figure 6:
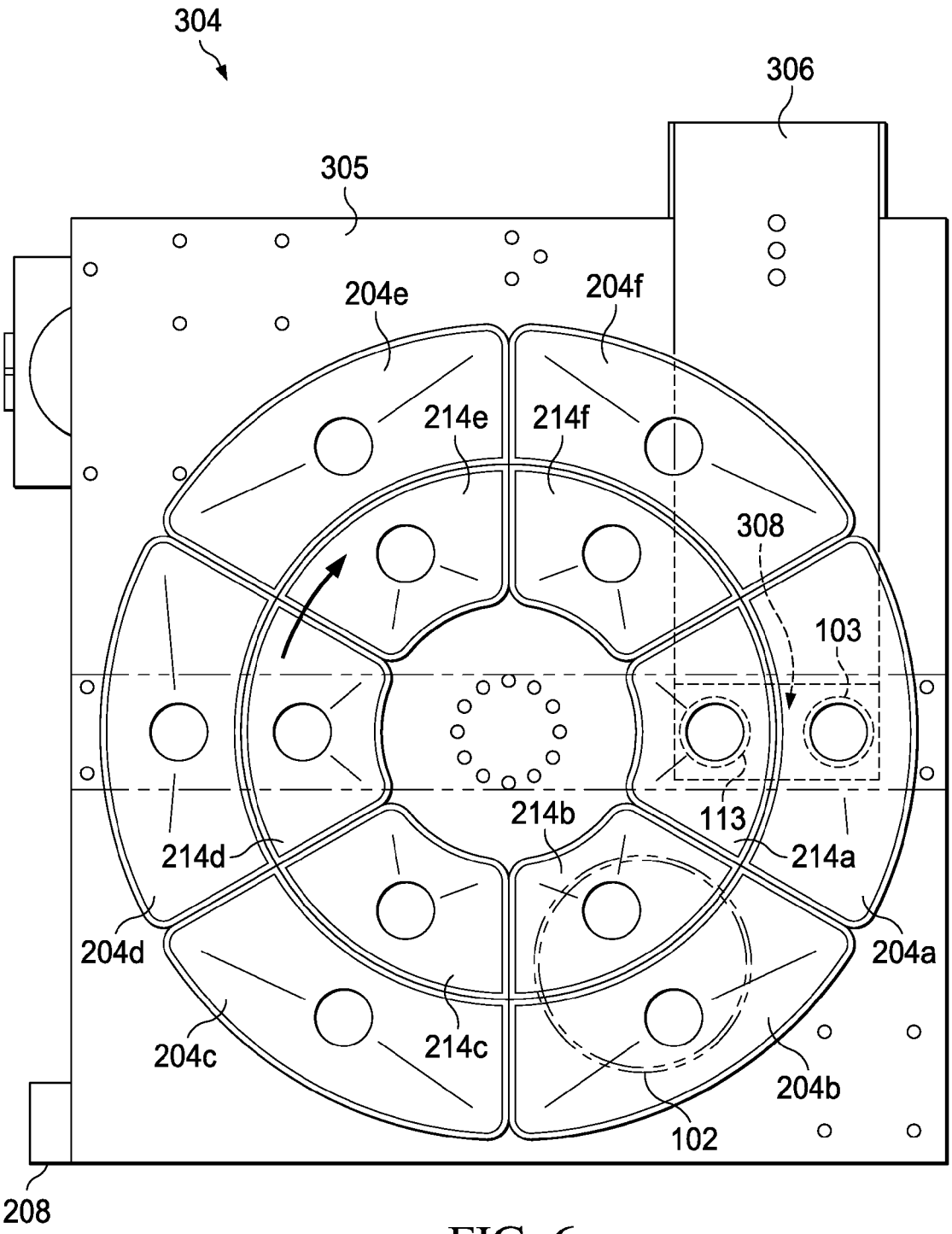
FIG. 6 is a top profile view of a rotary settling device comprising multiple settling chambers in their discharging and receiving positions.

In one embodiment, the settling device 207 comprises only the settling chambers 204, 214 for each slug of product to be packaged. In other embodiments, the settling device 207 comprises multiple settling chambers 204, 214 that act in parallel, each discharging its slug of product to the downstream product delivery cylinders 103, 113. FIG. 6 is a top profile view of a rotary settling device comprising multiple settling chambers in their discharging and receiving positions. The rotary settling device 304 shown in FIG. 6 comprises twelve settling chambers 204*a-f*, 214*a-f* located above the stationary turret table 305, a gate 306, and a vibrator 208. Those skilled in the art will understand that the number of settling chambers in a single position is dependent upon the number of product delivery cylinders of the multiple bagmaker and the settling chambers grouped at a position rotate together such that they receive and discharge product simultaneously. Thus, if a triplex bagmaker were being used, there would be a third settling chamber (not shown) at each position a-f. The multiple-chamber rotary settling device operates as described above in reference to compacting and packaging a single slug of product.

While the invention has been particularly shown and described with reference to a preferred embodiment, it will be understood by those skilled in the art that various changes in form and detail may be made therein without departing from the spirit and scope of the invention.

Additional Description

The following clauses are offered as further description of the disclosed invention.

1. An apparatus for compacting and packaging a plurality of product slugs simultaneously, said apparatus comprising:
   a multiple bagmaker, said bagmaker having a number of product delivery cylinders;
   a weigher; and
   a settling device;
   wherein said settling device is located between said weigher and said product delivery cylinder.
2. The apparatus according to any preceding clause wherein said weigher is divided into a number of sections equal to said number of product delivery cylinders.
3. The apparatus according to any preceding clause wherein said multiple bagmaker comprises a duplex vertical form, fill, and seal machine.
4. The apparatus according to any preceding clause wherein said settling device comprises at least two settling chambers.
5. The apparatus of claim 4 wherein said settling chambers comprise a cross-sectional shape substantially similar to the desired shape of the product slug.
6. The apparatus according to any preceding clause wherein said settling chambers comprise a substantially oval cross-section.
7. The apparatus according to any preceding clause wherein said settling chambers comprise a top end and a bottom end, and wherein said bottom end comprises a larger opening than said top end.
8. The apparatus according to any preceding clause wherein said settling device further comprises a gate.
9. The apparatus according to any preceding clause wherein said settling devices comprise at least four settling chambers and at least one gate, wherein said settling chambers are axially rotatable within the settling device, and wherein a number of said settling chambers equal to said number of said product delivery cylinders are grouped at a single position.
10. The apparatus according to any preceding clause further comprising a stationary turret table, wherein said stationary turret table is located below said settling chambers.
11. The apparatus according to any preceding clause 10 wherein said stationary turret table comprises an opening located above said gate.
12. The apparatus according to any preceding clause further comprising a stationary table located above said at least four rotating settling chambers.
13. The apparatus according to any preceding clause further comprising at least one funnel located above said at least two rotating settling chambers.
14. The apparatus according to any preceding clause wherein said settling device further comprises a vibrator.
15. A method for compacting and packaging a plurality of product slugs with an apparatus comprising a multiple bagmaker having a number of product delivery cylinders, said method comprising:
    a) weighing a plurality of product slugs in a weigher, wherein said weigher is divided into a number of sections equal to said number of product delivery cylinders;
    b) receiving said plurality of product slugs to a settling device;
    c) compacting said plurality of product slugs in said settling device to form compact slugs of product;

d) discharging said compact slugs of product to said number of product delivery cylinders, wherein each compact slug of product is discharged into a separate product delivery cylinder; and e) depositing said slugs of product from said product delivery cylinders to packages, wherein said settling device is located downstream from said weigher and upstream from said product delivery cylinder.

16. The method according to any preceding clause wherein said receiving step comprises receiving product into at least four settling chambers, wherein a number of said settling chambers equal to said number of said product delivery cylinders are grouped together.

17. The method according to any preceding clause wherein said compacting step comprises rotating said product in four settling chambers, wherein said settling chambers are axially rotatable within the settling device.

18. The method according to any preceding clause wherein said compacting step comprises vibrating said settling device.

19. The method according to any preceding clause wherein said depositing step comprises depositing said slugs into a duplex vertical form, fill, and seal machine.

20. The method according to any preceding clause wherein said receiving step and said discharging step occur simultaneously.

21. The method according to any preceding clause wherein said receiving step comprises receiving product into at least one settling chamber, and wherein said depositing step comprises depositing at least two slugs from at least one settling chambers into a package.

What is claimed is:

1. An apparatus for compacting and packaging a plurality of product slugs simultaneously, said apparatus comprising:

a multiple bagmaker, said bagmaker having a number of product delivery cylinders;

a weigher split into sections, each section weighing and discharging a slug of product into a corresponding receiving funnel which guides product into a settling device, the settling device comprising at least four settling chambers, a gate, and a vibrator; and wherein said settling device is located between said weigher and said product delivery cylinders, wherein said settling chambers are axially rotatable within the settling device, and wherein a number of said settling chambers equal to said number of said product delivery cylinders are grouped at a single position.

2. The apparatus of claim 1 wherein said weigher is divided into a number of sections equal to said number of product delivery cylinders.

3. The apparatus of claim 1 wherein said multiple bagmaker comprises a duplex vertical form, fill, and seal machine.

4. The apparatus of claim 1 wherein said settling chambers comprise a cross-sectional shape substantially similar to the desired shape of the product slug.

5. The apparatus of claim 4 wherein said settling chambers comprise a substantially oval cross-section.

6. The apparatus of claim 1 wherein said settling chambers comprise a top end and a bottom end, and wherein said bottom end comprises a larger opening than said top end.

7. The apparatus of claim 1 further comprising a stationary turret table, wherein said stationary turret table is located below said settling chambers.

8. The apparatus of claim 7 wherein said stationary turret table comprises an opening located above said gate.

9. The apparatus of claim 1 further comprising a stationary table located above said at least four rotating settling chambers.

* * * * *